US007303443B1

(12) United States Patent
Beaman et al.

(10) Patent No.: US 7,303,443 B1
(45) Date of Patent: Dec. 4, 2007

(54) SOCKET AND METHOD FOR COMPENSATING FOR DIFFERING COEFFICIENTS OF THERMAL EXPANSION

(75) Inventors: Brian Samuel Beaman, Apex, NC (US); Joseph Kuczynski, Rochester, MN (US); Theron Lee Lewis, Rochester, MN (US); Amanda Elisa Ennis Mikhail, Rochester, MN (US); Arvind Kumar Sinha, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/548,789

(22) Filed: Oct. 12, 2006

(51) Int. Cl.
*H01R 24/00* (2006.01)

(52) U.S. Cl. ..... 439/637

(58) Field of Classification Search ..... 439/62, 439/59, 637, 328; 361/711
See application file for complete search history.

(56) References Cited

U.S. PATENT DOCUMENTS 4,713,013 A 12/1987 Regnier et al.
5,049,087 A * 9/1991 Chung et al. ..... 439/259
5,145,381 A * 9/1992 Volz ..... 439/62
5,145,395 A * 9/1992 Kuei Lai ..... 439/326
5,273,442 A * 12/1993 Laub ..... 439/73
5,451,815 A * 9/1995 Taniguchi et al. ..... 257/696
5,704,807 A * 1/1998 Sherman et al. ..... 439/570
6,021,048 A * 2/2000 Smith ..... 361/736
6,139,336 A 10/2000 Olson
6,168,464 B1 1/2001 Choy et al.
6,203,338 B1 3/2001 Choy
6,302,705 B1 * 10/2001 Yatskov et al. ..... 439/67
6,431,889 B1 8/2002 Olson
6,454,157 B2 9/2002 Olson
6,498,551 B1 12/2002 Ammar et al.
6,558,181 B2 5/2003 Chung et al.
6,857,908 B2 * 2/2005 Burmeister ..... 439/632
2003/0171014 A1 * 9/2003 Lin ..... 439/79

* cited by examiner

*Primary Examiner*—Tulsidas C. Patel
*Assistant Examiner*—Harshad C Patel
(74) *Attorney, Agent, or Firm*—Duke W. Yee; Gregory M. Doudnikoff; Brandon G. Williams

(57) ABSTRACT

The illustrative embodiments provide a socket, a method for manufacturing the socket, a device, and a method for compensating for a difference in the coefficients of thermal expansion between a socket and a printed circuit board. The socket includes surface mounted contacts and an elongated housing. The elongated housing comprises an aperture, wherein the surface mounted contacts extend from the aperture. At least one plate connects to the elongated housing, wherein the at least one plate has a coefficient of thermal expansion selected to compensate for a difference in coefficients of thermal expansion between the socket and a printed circuit board.

10 Claims, 2 Drawing Sheets

SOCKET AND METHOD FOR COMPENSATING FOR DIFFERING COEFFICIENTS OF THERMAL EXPANSION

BACKGROUND OF THE INVENTION

1. Field of the Invention

The present invention relates generally to a socket. More particularly, the present invention relates to a socket, a method for manufacturing the socket, a device, and a method for compensating for differing coefficients of thermal expansion between a surface mounted socket and a printed circuit board.

2. Description of the Related Art

Dual in-line memory module (DIMM) sockets are used in computers to electrically connect memory modules to a processor package that is mounted on a printed circuit board. Currently, pins are the most popular means for physically attaching dual in-line memory module sockets to circuit boards. The pins fit through holes in the circuit board, and, typically, the pins are either soldered or press-fitted to the board, thereby forming a physical connection between the dual in-line memory module socket and the printed circuit board. The physical connection allows electrical signals to pass between the memory module residing in the dual in-line memory module socket and the processor package mounted on the printed circuit board. However, recent increases in processor performance are requiring higher electrical signal speeds to pass within a memory bus. As a result, electrical performances of the present dual in-line memory module socket pin design are insufficient. Therefore, the industry is moving towards new surface mounted lead designs to attach dual in-line memory module sockets to the circuit boards.

However, many manufacturing difficulties exist with surface mounted dual in-line memory module socket designs. The greatest challenge surrounds the differences in the coefficients of thermal expansion (CTE) between the dual in-line memory module socket housing material and the printed circuit board material. In manufacturing, a soldering reflow process is used to attach the dual in-line memory module socket to the circuit board. The soldering reflow process exposes the dual in-line memory module socket and the circuit board to extremely high temperatures. Because of the differences in the coefficients of thermal expansion, the dual in-line memory module socket housing and the circuit board expand at different rates during heating. Consequently, the circuit board tends to warp and create stress on the solder joints between the circuit board and the dual in-line memory module socket. The solder joint stress causes the joints to crack, which eventually results in broken electrical connections and memory bus failures after multiple on and off cycles.

Several solutions currently exist to address the warping problem arising from the differences in the coefficients of thermal expansion. One solution is to change the dual in-line memory module housing material to a material that has a similar coefficient of thermal expansion as the circuit board. Another solution is to apply a mechanical fixture and utilize thermal management techniques during the solder reflow process to control the warping. Yet another solution includes flattening the warped circuit board using a clamping fixture and an extended high temperature annealing of the solder joint stress. However, due to either unacceptable results or significant additional manufacturing costs, none of the solutions have been attractive.

BRIEF SUMMARY OF THE INVENTION

The illustrative embodiments provide a socket, a method for manufacturing the socket, a device, and a method for compensating for a difference in the coefficients of thermal expansion between a socket and a printed circuit board. The socket includes surface mounted contacts and an elongated housing. The elongated housing comprises an aperture, wherein the surface mounted contacts extend from the aperture. At least one plate connects to the elongated housing, wherein the at least one plate has a coefficient of thermal expansion selected to compensate for a difference in coefficients of thermal expansion between the socket and a printed circuit board.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
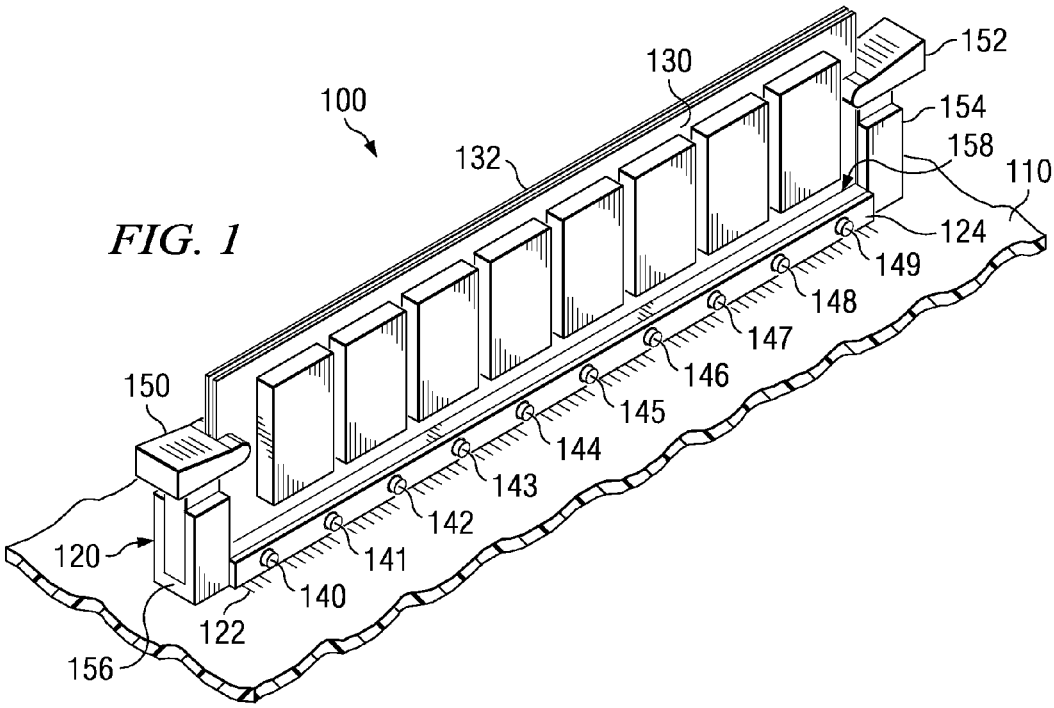
FIG. 1 is a diagram of a printed circuit board assembly, in which an illustrative embodiment may be implemented.
Figure 2:
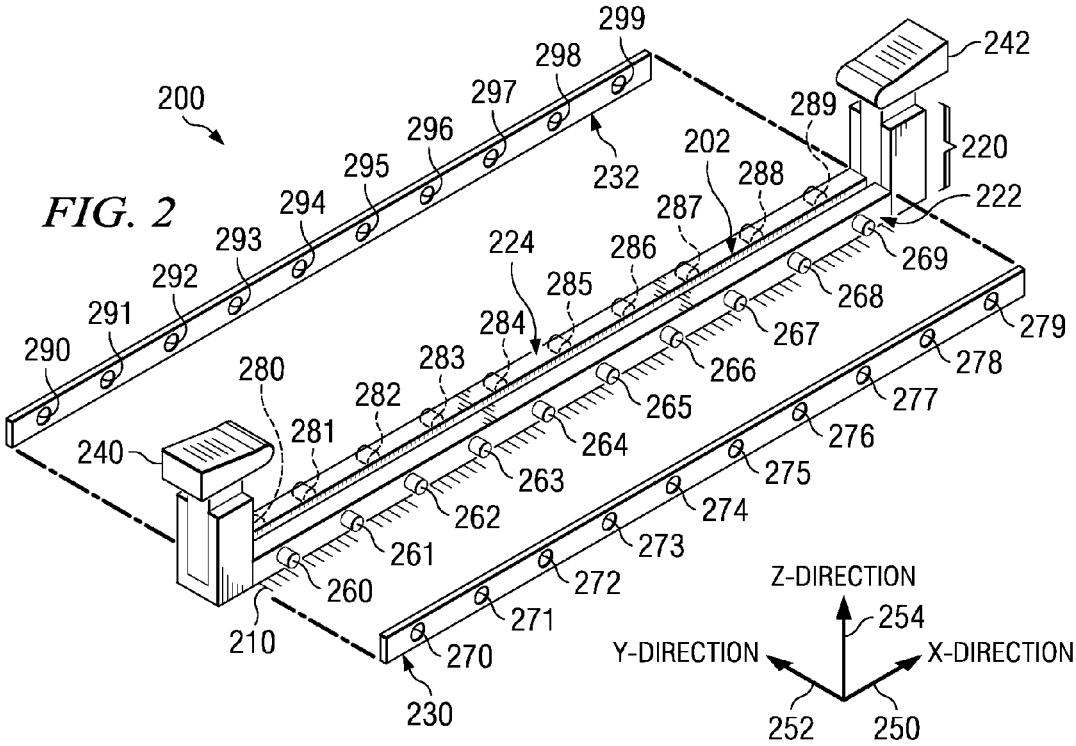
FIG. 2 illustrates an exploded view of a socket, in accordance with an illustrative embodiment.

FIG. 1 is a diagram of a printed circuit board assembly, in which an illustrative embodiment may be implemented. Printed circuit assembly 100 includes printed circuit board 110, socket 120, and modules 130 and 132. Printed circuit board 110 is a laminated board used to mechanically and electrically support electronic components. In the illustrative embodiment, printed circuit board 110 is made using photolithography with copper foil laminated on multiple layers of epoxy glass, composite material.

Socket 120 electrically connects a module, such as modules 130 and 132, to printed circuit board 110. In the illustrative embodiment, socket 120 is a dual in-line memory module (DIMM) socket. However, socket 120 is not limited to the illustrative embodiment and may include more or fewer modules and different types of modules, such as a processor, a graphics card, a hard disk controller, or a sound card.

Socket 120 includes surface mounted contacts 122, elongated housing 124, mounting members 140 through 149, and opposing end caps 154 and 156 comprising latches 150 and 152. Surface connections on printed circuit board 110 are soldered to surface mounted contacts 122 to attach socket 120 directly to printed circuit board 110. Elongated housing 124 is a single elongated member with aperture 158 disposed in the middle of elongated housing 124. Mounting members 140 through 149 are disposed on an external edge of elongated housing 124. Mounting members 140 through 149 allow for a compensating mechanism, such as a plate, to attach to elongated housing 124.

Surface mounted contacts 122 are coupled to and extend from aperture 158 of elongated housing 124, and elongated housing 124 houses modules 130 and 132 in aperture 158. Latches 150 and 152, located at opposite ends of elongated housing 124, mechanically retain modules 130 and 132 in socket 120.

Surface mounted contacts 122 are coupled to and extend from the aperture of elongated housing 124, and elongated housing 124 houses modules 130 and 132 in the aperture. Opposing end caps 154 and 156 comprising latches 150 and 152, located at opposite ends of elongated housing 124 mechanically retain modules 130 and 132 in socket 120.

Socket 200 includes surface mounted contacts 210, elongated housing 220, plates 230 and 232, and latches 240 and 242. Surface mounted contacts 210 are similar to surface mounted contacts 122 of FIG. 1 and form the base of socket 200. Socket 200 may have any number of contacts. Typically, socket 200 will have anywhere between 240 to 300 individual contacts. Each contact is a pin, spring, or metal pad designed to contact a hole, metal pin, or spring, respectively, on a printed circuit board. Surface mounted contacts 210 are soldered onto a printed circuit board and form solder joints that physically connect socket 200 to the printed circuit board.

Elongated housing 220 is similar to elongated housing 124 of FIG. 1. Typically, elongated housing 220 is formed from a high temperature plastic resin, such as a liquid crystal polymer (LCP) or high temperature nylon. However, elongated housing 220 may also be made from other materials or composite structures, such as metals or metal alloys with insulating coatings, and is not intended to limit the exemplary embodiments to any particular material. In the illustrative embodiment, elongated housing 220 is formed from a liquid crystal polymer.

Elongated housing 220 may be equally or unequally dimensioned in length (x-direction 250), width (y-direction 252), and height (z-direction 254), with each dimension ranging anywhere from 0.05 inches to 24 inches. Typically, elongated housing 220 is proportionally longer in one direction than in the other two directions. In the illustrative embodiment, elongated housing 220 is proportionally longer in length than in width and height. Specifically, in the illustrative embodiment, elongated housing 220 is 6.25 inches in length, 0.35 inches in width, and 0.25 inches in height.

Elongated housing 220 has two external edges, 222 and 224, and includes aperture 202 disposed in the middle of elongated housing 220. Plates 230 and 232 are attached to external edges 222 and 224, respectively. Plates 230 and 232 compensate for the differences in the coefficients of thermal expansion (CTE) between the printed circuit board and elongated housing 220. Coefficient of thermal expansion is a measure of how much a particular material expands or contracts when exposed to different temperatures. Each material and combination of materials has a different coefficient of thermal expansion, and, therefore, expands or contracts at different rates. For example, a component made from liquid crystal polymer has a different coefficient of thermal expansion and expands or contracts at a different rate than a component made from copper. Furthermore, a component made from a combination of both liquid polymer crystal and copper has a different coefficient of thermal expansion and expands or contracts at a different rate than a component made only from a liquid crystal polymer or only from copper.

During manufacturing, socket 200 and the printed circuit board to which socket 200 is attached may be exposed to extremely high temperatures as part of a solder reflow process. Sometimes the temperatures are in excess of 260 degrees Celsius. Generally, the printed circuit board and elongated housing 220 are not made from the same material and are made from a combination of different materials. Consequently, the printed circuit board and elongated housing 220 have different coefficient of thermal expansion values. For example, typically, the coefficient of thermal expansion for a printed circuit board is between ten to fifteen parts per million (PPM) per degrees Celsius, while the coefficient of thermal expansion for an elongated housing made with liquid polymer crystal is between two and five parts per million per degrees Celsius. Therefore, when exposed to heat during the solder reflow process, the printed circuit board and elongated housing 220 expand at different rates.

Plates 230 and 232 compensate for the coefficient of thermal expansion of elongated housing 220, thereby allowing elongated housing 220 to expand or contract approximately the same amount and at the same rate as the printed circuit board. In effect, by connecting plates 230 and 232 to external edges 222 and 224 respectively, plates 230 and 232 expand or contract elongated housing 220 more than elongated housing 220 would expand on its own. As a result, the differences in the coefficient of thermal expansion between elongated housing 220 and the printed circuit board are reduced, and, essentially, the coefficient of thermal expansion of the combination of plates 230 and 232 and elongated housing 220 mimics the effects of the coefficient of thermal expansion of the printed circuit board. Consequently, the similar expansion rate reduces warping of the printed circuit board, decreases the solder joint stress between surface mounted contacts 210 extending from elongated housing 220 and the printed circuit board, and eliminates the exposure to broken electrical connections and memory bus failures.

Plates 230 and 232 are thin plates having a thickness (y-direction 252) ranging anywhere from 0.001 inches to 0.1 inches. Plates 230 and 232 may be the same length (x-direction 250) and height (z-direction 254) as external edges 222 and 224 respectively. However, plates 230 and 232 are not limited to the illustrative embodiment and can each have different dimensions. However, similar length and height dimensions maximize the coefficient of thermal expansion compensation of elongated housing 220 and allow elongated housing 220 to expand in a comparable manner as the printed circuit board. In the illustrative embodiment, plates 230 and 232 are 0.01 inches thick and have the same length and height dimensions as external edges 222 and 224.

Plates 230 and 232 may be fabricated from a rigid plastic resin, a metal or metal alloy, or a combination of a metal and plastic resin. Typically, plates 230 and 232 are made from a metal, such as copper, stainless steel, or brass. The material of the printed circuit board may contribute to the determination of the most appropriate material for plates 230 and 232. In one embodiment, the appropriate material for plates 230 and 232 equalizes the coefficient of thermal expansion of the printed circuit board and elongated housing 220. Therefore, the appropriate material for plates 230 and 232 may be the same material from which the printed circuit board is made. Additionally, plates 230 and 232 may each be a single, continuous part or encompass a number of smaller plates. Plates 230 and 232 may also be a solid or composite pattern or take the form of a mesh pattern. In the illustrative embodiment, plates 230 and 232 are each one composite, continuous piece fabricated from a copper metal.

In the illustrative embodiment, at least one plate, 230 or 232, is disposed on at least one external edge, 222 or 224. More or fewer plates may be disposed along each external edge, 222 and 224; however, an equal number of plates on each edge balances the coefficient of thermal expansion and expansion rates throughout socket 200. Additionally, the disposition of plates 230 and 232 on an internal edge of elongated housing 220 is possible but generally not preferred.

Mounting members 260 through 269 are disposed on external edge 222. Mounting members 260 through 269 are the mechanism for attaching plate 230 to elongated housing 220. Mating members 270 through 279 are disposed along one edge of plate 230. Mating members 270 through 279 are the corresponding attachments to mounting members 260 through 269. Plate 230 may be mounted onto elongated housing 220 using any known mounting process, such as thermal staking, insert molding, snapping, or welding.

In the illustrative embodiment, mounting members 260 through 269 and mating members 270 through 279 are circular. Additionally, in the illustrative embodiment, mounting members 260 through 269 are extending out of elongated housing 220, and mating members 270 through 279 are apertures. In the illustrative embodiment, each mounting member, 260 through 269, slides through the corresponding mating member 270 through 279 to connect plate 230 to elongated housing 220. However, mounting members 260 through 269 and mating members 270 through 279 may take any shape, such as a triangle, square, or rectangle, or any form appropriate for the mounting process that is to be used to attach plate 230 to elongated housing 220. However, mounting members 260 through 269 should correspond in shape and form to mating members 270 through 279.

A similar set of mounting members exists on external edge 224 so that plate 232 may be connected to elongated housing 220. External edge 224 includes mounting members 280 through 289. Plate 232 includes mating members 290 through 299. In the illustrative embodiment, mounting members 280 through 289 are circular and extend out of external edge 224, and mating members 290 through 299 are apertures.

External edges 222 and 224 and plates 230 and 232 are not limited to the number and distribution of mounting and mating members as shown in the illustrative embodiments. More or fewer mounting and mating members may exist on external edges 222 and 224 and plates 230 and 232, respectively. The mounting and mating members may also be unevenly distributed along the length of external edges 222 and 224 and plates 230 and 232. However, the number and distribution pattern of mounting members 260 through 269 should correspond to the number and distribution pattern of mating members 270 through 279. Likewise, the number and distribution pattern of mounting members 280 through 289 should correspond to the number and distribution pattern of mating members 290 through 299. Additionally, external edge 222 and plate 230 do not need to have the same number of mounting and mating members as external edge 224 and plate 232. External edge 222 and plate 230 may have more or fewer mounting and mating members than external edge 224 and plate 232.

Figure 3:
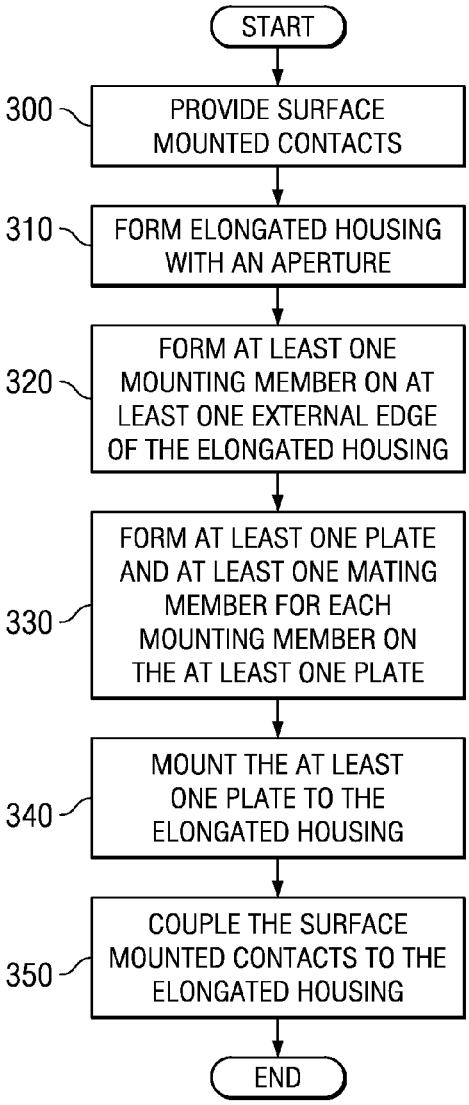
FIG. 3 is a flowchart illustrating the process for manufacturing a socket, in accordance with an illustrative embodiment.

FIG. 3 is a flowchart illustrating the process for manufacturing a socket in accordance with an illustrative embodiment. The following process is exemplary only and the order of each step may be interchanged without deviating from the scope of the invention. The process begins with providing surface mounted contacts (step 300). An elongated housing that has an aperture is then formed (step 310). At least one mounting member is then formed on at least one external side of the elongated housing (step 320). At least one plate and at least one mating member for each mounting member is formed on the at least one plate (step 330). The at least one plate is then mounted to the elongated housing (step 340). The surface mounted contacts are then coupled to the elongated housing so that the surface mounted contacts extend from the aperture in the elongated housing (step 350), and the process terminates thereafter.

Figure 4:
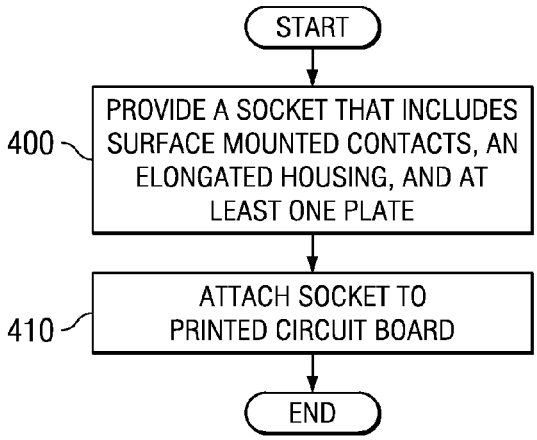
FIG. 4 is a flowchart illustrating a method for compensating for a difference in the coefficients of thermal expansion between a socket and a printed circuit board, in accordance with an illustrative embodiment.

FIG. 4 is a flowchart illustrating a method for compensating for a difference in the coefficients of thermal expansion between a socket and a printed circuit board, in accordance with an illustrative embodiment. The following process is exemplary only and the order of each step may be interchanged without deviating from the scope of the invention. The process begins with providing a socket that includes surface mounted contacts, an elongated housing, and at least one plate (step 400). The elongated housing includes an aperture and at least one external edge. The surface mounted contacts extend from the aperture. At least one plate connects to the elongated housing. The socket is then attached to the printed circuit board (step 410), with the process terminating thereafter.

The illustrative embodiments provide a socket, a method of manufacturing the socket, a device, and a method for compensating for a difference in the coefficients of thermal expansion between a socket and a printed circuit board. The socket includes surface mounted contacts and an elongated housing. The elongated housing has an aperture. The surface mounted contacts extend from the aperture. At least one plate connects to the elongated housing. The at least one plate has a coefficient of thermal expansion that is selected to compensate for a difference in the coefficient of thermal expansion between the socket and a printed circuit board. An additional plate may also be connected to the elongated housing. At least one mounting member is disposed on each external edge of the elongated housing. At least one mating member is disposed on the edge of each plate. The mounting member mounts to the mating member so that at least one plate connects to an external edge of the elongated housing.

The socket compensates for differing coefficients of thermal expansion between a socket and a printed circuit board. The socket reduces the differences in the coefficients of thermal expansion and essentially allows for the socket to mimic the effects of the coefficient of thermal expansion of the printed circuit board. As a result, the socket reduces warping of the printed circuit board, decreases the solder joint stress between the surface mounted contacts and the printed circuit board, and eliminates the exposure to broken electrical connections and memory bus failures.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A socket comprising:

surface mounted contacts;

an elongated housing comprising opposing external edges and opposing end caps defining an aperture, wherein the surface mounted contacts extend from the aperture; and at least one plate connected to and disposed along at least one of the external edges, wherein the at least one plate has a coefficient of thermal expansion selected to compensate for a difference in coefficients of thermal expansion between the socket and a printed circuit board.

2. The socket of claim 1 further comprising:

at least one mounting member disposed on at least one of the opposing external edges of the elongated housing; and at least one mating member disposed on an edge of the at least one plate, wherein the at least one mating member corresponds to the at least one mounting member, and wherein the at least one mating member mounts to the at least one mounting member to connect the at least one plate to the elongated housing.

3. The socket of claim 2 wherein the at least one mating member connects to the at least one mounting member using a process, wherein the process is one of a thermal staking process, a welding process, a snapping process, or an insert molding process.

4. The socket of claim 2 wherein the at least one mounting member is a plurality of mounting members, and wherein the at least one mating member is a plurality of mating members, and wherein the plurality of mounting members corresponds to the plurality of mating members.

5. The socket of claim 1 wherein the elongated housing comprises plastic, and wherein the at least one plate comprises metal.

6. The socket of claim 1 wherein the at least one plate is a composite pattern or a mesh pattern.

7. The socket of claim 1 wherein the at least one plate comprises copper.

8. A device comprising:

a printed circuit board;

surface mounted contacts mounted to the printed circuit board; and a socket mounted to the printed circuit board, wherein the socket comprises:

an elongated housing comprising opposing external edges and opposing end caps defining an aperture, wherein the surface mounted contacts extend from the aperture;

at least one module coupled to the elongated housing; and at least one plate connected to and disposed along at least one external edge of the elongated housing, wherein the at least one plate has a coefficient of thermal expansion selected to compensate for a difference in coefficients of thermal expansion between the socket and the printed circuit board.

9. The device of claim 8 further comprising:

at least one mounting member disposed on the at least one of the opposing external edges; and at least one mating member disposed on an edge of the at least one plate, wherein the at least one mating member corresponds to the at least one mounting member, and wherein the at least one mating member mounts to the at least one mounting member to connect the at least one plate to the elongated housing.

10. The device of claim 9 wherein the at least one mounting member is a plurality of mounting members, and wherein the at least one mating member is a plurality of mating members, and wherein the plurality of mounting members corresponds to the plurality of mating members.

* * * * *